US007223182B2

(12) United States Patent
Fushihara

(10) Patent No.: US 7,223,182 B2
(45) Date of Patent: May 29, 2007

(54) FLOATABLE GOLF BALL FOR DRIVING RANGE

(75) Inventor: Kazuhisa Fushihara, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 231 days.

(21) Appl. No.: 09/854,693

(22) Filed: May 15, 2001

(65) Prior Publication Data

US 2002/0042309 A1 Apr. 11, 2002

(30) Foreign Application Priority Data

May 15, 2000 (JP) ..... 2000-141548

(51) Int. Cl.
*A63B 37/06* (2006.01)

(52) U.S. Cl. ..... 473/378

(58) Field of Classification Search ..... 473/352, 473/377, 378

See application file for complete search history.

(56) References Cited

U.S. PATENT DOCUMENTS 4,085,937 A * 4/1978 Schenk ..... 473/352
5,695,413 A * 12/1997 Yamagishi et al. ..... 473/374
5,842,936 A * 12/1998 Mast ..... 473/352
5,931,747 A * 8/1999 Mast ..... 473/352

FOREIGN PATENT DOCUMENTS

JP 06-327791 * 11/1994
JP A6327791 11/1994

* cited by examiner

*Primary Examiner*—Raeann Gorden
(74) *Attorney, Agent, or Firm*—Birch, Stewart, Kolasch & Birch, LLP

(57) ABSTRACT

The present invention provides a floatable golf ball for a driving range having excellent durability and good shot feel. The present invention relates to a floatable golf ball for a driving range comprising a core and a cover covering the core, wherein the cover has a flexural modulus (F) of 80 to 300 MPa, the golf ball has a specific gravity of not less than 0.5 and less than 1.0, and a deformation amount (D) of 3.0 to 6.0 mm when applying from an initial load of 98 N to a final load of 1275 N, and a ratio (F/D) of the flexural modulus of the cover (F) to the deformation amount of the golf ball (D) is within the range of 15 to 50.

1 Claim, 1 Drawing Sheet

FIGURE
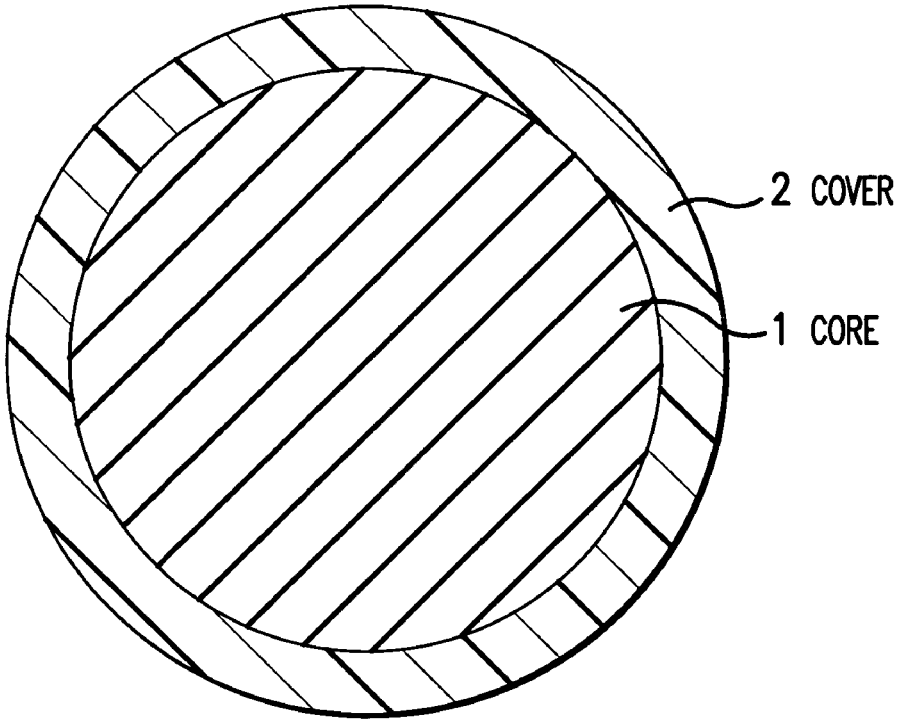

FLOATABLE GOLF BALL FOR DRIVING RANGE

FIELD OF THE INVENTION

The present invention relates to a floatable golf ball for a driving range. More particularly, it relates to a floatable golf ball for a driving range, which has excellent durability and good shot feel.

BACKGROUND OF THE INVENTION

There are driving ranges for practicing golf, in which golf balls are hit facing water surface of a lake and collected from water. The golf balls should float on the water surface and therefore have a specific gravity of less than 1.0. These types of driving ranges are called hereinafter as "water-facing driving range" and these golf balls are called as "floatable golf ball". The performance, which is required for golf balls for usual land-facing driving ranges, is firstly excellent durability, and secondly good shot feel as good as golf balls for round games.

In case of the floatable golf balls for water-facing driving ranges, since it is further required to float on water in order to easily collect the golf balls after hitting, it is a necessary condition for the golf balls to have a specific gravity of less than 1.0. As a golf ball which satisfies the required performance, that is, durability, shot feel and specific gravity, one-piece golf ball has been mainly employed. This is because the one-piece golf ball is suitable for satisfying the required performance, and particularly because the golf ball has excellent durability.

Recently, it has been required also for the golf balls for usual driving ranges to have excellent performance nearly as good as golf balls for round games. Therefore so-called two-piece golf ball, which is formed by covering a cover, has been employed as a floatable golf ball for water-facing driving ranges. A two-piece floatable golf ball for water-facing driving ranges, which has low specific gravity and floats on water, and has good shot feel nearly as good as golf balls for round games, is proposed (Japanese Patent Kokai Publication No. 327791/1994 and the like).

However, the golf ball for round games has possessed very soft and good shot feel and high rebound characteristics by the recent remarkable improvement of performance of the golf ball. Therefore the two-piece floatable golf ball for water-facing driving ranges was evaluated to have good shot feel when it was proposed, but such a conventional golf ball for driving ranges does not agree with requirement for the existing golf ball. It is problem that the conventional golf ball for driving ranges is very hard and has poor shot feel, because the core is hard and stiffness of the cover is too high.

OBJECTS OF THE INVENTION

A main object of the present invention is to provide a floatable golf ball for a driving range, which has excellent durability and good shot feel.

According to the present invention, the object described above has been accomplished in a two-piece golf ball comprising a core and cover by adjusting a flexural modulus of the cover, a specific gravity of the golf ball, a deformation amount of the golf ball when applying from an initial load of 98 N to a final load of 1275 N and a ratio (F/D) of the flexural modulus of the cover (F) to the deformation amount of the golf ball (D) to specific ranges, thereby providing a floatable golf ball for a driving range, which has excellent durability and good shot feel.

BRIEF DESCRIPTION OF THE DRAWINGS

The Figure of the present application identifies a floatable golf ball containing a core and a cover surrounding the core.

SUMMARY OF THE INVENTION

The present invention provides a floatable golf ball for a driving range comprising a core (1) and a cover (2) covering the core, wherein the cover has a flexural modulus (F) of 80 to 300 MPa, the golf ball has a specific gravity of not less than 0.5 and less than 1.0, and a deformation amount (D) of 3.0 to 6.0 mm when applying from an initial load of 98 N to a final load of 1275 N, and a ratio (F/D) of the flexural modulus of the cover (F) to the deformation amount of the golf ball (D) is within the range of 15 to 50.

In the golf ball of the present invention, the golf ball is soft and good shot feel is accomplished by covering the sufficiently soft core with the cover having low stiffness. In the golf ball of the present invention, it is required for a deformation amount when applying from an initial load of 98 N to a final load of 1275 N (ball compression), which represents a softness of the golf ball, to be within the range of 3.0 to 6.0 mm, preferably 3.2 to 5.5 mm, more preferably 3.6 to 4.0 mm. When the deformation amount is smaller than 3.0 mm, the golf ball is too hard, and the shot feel is poor. On the other hand, when the deformation amount is larger than 6.0 mm, the golf ball is too soft, and the durability is largely degraded.

It is required for the golf ball of the present invention to have a specific gravity of not less than 0.5 and less than 1.0, preferably 0.8 to 0.99, more preferably 0.90 to 0.98, because it is required for the golf ball of the present invention to float on water. When the specific gravity is within the range of not less than 1.0, the golf ball does not float on water, and it is not suitable to use as a floatable golf ball for a driving range. On other hand, when the specific gravity is smaller than 0.5, the weight of the golf ball is small, and the flight distance is small. In addition, the shot feel is too light, and it is largely different from the shot feel of golf ball for round games.

In the golf ball of the present invention, it is required for the cover to have a flexural modulus of 80 to 300 MPa, preferably 80 to 200 MPa, more preferably 85 to 170 MPa. When the flexural modulus is smaller than 80 MPa, the cover is too soft, and it is easy to cut at the time of hitting and the durability is poor. On the other hand, when the flexural modulus is larger than 300 MPa, if softening the core, the golf ball is too hard, and the shot feel is poor.

The golf ball of the present invention has good shot feel by adjusting a deformation amount when applying from an initial load of 98 N to a final load of 1275 N to not less than 3.0 mm as described above. However, it is still problem that the durability is degraded in case of the golf ball having large deformation amount. It has been conventionally considered to employ a method of heightening the flexural modulus of the cover in order to improve the durability while maintaining small deformation amount of the golf ball. However, when the flexural modulus of the cover is high by making the deformation amount of the golf ball large, a difference in the flexural modulus between the cover and core is too large, and the shear strain between the cover and core is large by the deformation at the time of hitting, which does not improve the durability.

The present inventors have noticed a ratio (F/D) of the flexural modulus of the cover F (MPa) to the deformation amount of the golf ball when applying from an initial load of 98 N to a final load of 1275 N (D), which has not been noticed. They have discovered that the shear strain is small by adjusting the ratio (F/D) to not more than 50 in case of the golf ball having large deformation amount (D), and the durability is improved. When the ratio (F/D) is larger than 50, only the cover is too hard and stress applied to the core is large, and the core is easy to cut. In addition, the deformation of the cover is too small for large deformation amount of the golf ball, and the shear strain between the cover and core is large. Thus the cover is easy to cut, and the durability is degraded. Therefore it is desired for the ratio (F/D) to be within the range of not more than 50, preferably not more than 40, more preferably no more than 35, most preferably not more than 31. When the ratio (F/D) is too small, the cover is soft, and the durability of the cover is degraded. Therefore it is desired for the ratio (F/D) to be within the range of not less than 15, preferably not less than 18, more preferably no less than 24.

DETAILED DESCRIPTION OF THE INVENTION

The floatable golf ball for a driving range of the present invention will be explained hereinafter in detail. The golf ball of the present invention is a two-piece golf ball comprising a core and a cover covering the core. The core used in the golf ball of the present invention is formed from a vulcanized molded article of a rubber composition. The rubber composition essentially comprises a base rubber, co-crosslinking agent, organic peroxide and filler.

The base rubber may be one, which has been conventionally used for cores of golf balls. Preferred is polybutadiene rubber containing a cis-1,4 bond of not less than 40%, preferably not less than 80%. The polybutadiene rubber used in the present invention may be polybutadiene rubber containing a syndyotactic-1,2-polybutadiene of 5 to 30% and a cis-1,4-polybutadiene of not less than 40%, which has high crystallinity and high melting point, in order to impart the resulting golf ball to a proper hardness, that is, proper compression without large amount of inorganic filler, which increase the specific gravity of the golf ball, and accomplish suitable shot feel and durability. Examples of the polybutadiene include "UBEPOL-VCR309 (trade name)" (composition: syndyotactic-1,2-polybutadiene of 9%, cis-1,4-polybutadiene of 89% and trans-1,4-polybutadiene of 2%), "UBEPOL-VCR412 (trade name)" (composition: syndyotactic-1,2-polybutadiene of 12%, cis-1,4-polybutadiene of 86% and trans-1,4-polybutadiene of 2%) and the like, which are commercially available from Ube Industries, Ltd.

The polybutadiene rubber may be optionally mixed with natural rubber, polyisoprene rubber, polychloroprene rubber, polybutyl rubber, styrene-butadiene rubber (SBR), ethylene-propylene-diene rubber (EPDM), acrylonitrile rubber and the like. If used, it is preferable to adjust the amount of the rubber other than the polybutadiene so that the amount of the polybutadiene is within the range of not less than 50 parts by weight, based on 100 parts by weight of the base rubber.

Examples of the co-crosslinking agents include a combination of α,β-unsaturated carboxylic acid having 3 to 8 carbon atoms (e.g. acrylic acid, methacrylic acid, etc.) and a metal oxide such as zinc oxide, which are separately compounded and react with each other during mixing the rubber composition to form a metal salt of α,β-unsaturated carboxylic acid; a metal salt of α,β-unsaturated carboxylic acid, which is originally in the form thereof (e.g. zinc acrylate, zinc methacrylate, etc.); or mixtures thereof. The amount of the co-crosslinking agent, when using a metal salt of α,β-unsaturated carboxylic acid, is from 5 to 30 parts by weight, preferably from 5 to 20 parts by weight, based on 100 parts by weight of the base rubber. When the amount of the co-crosslinking agent is larger than 30 parts by weight, the specific gravity of the resulting golf ball is large, and the amount of low specific gravity filler is large, which degrades the durability. In addition the core is hard, and the shot feel is poor. On the other hand, when the amount of the co-crosslinking agent is smaller than 5 parts by weight, the rebound characteristics of the resulting golf ball are degraded. When using the combination of α,β-unsaturated carboxylic acid and metal oxide, the amount of the α,β-unsaturated carboxylic acid is from 3 to 20 parts by weight, preferably from 5 to 15 parts by weight, and the amount of the metal oxide is from 3 to 20 parts by weight, preferably from 5 to 15 parts by weight, based on 100 parts by weight of the base rubber.

Examples of the organic peroxides include, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is 0.1 to 5.0 parts by weight, preferably 0.5 to 3.0 parts by weight, based on 100 parts by weight of the base rubber. When the amount of the organic peroxide is smaller than 0.1 parts by weight, the core is too soft, and the rebound characteristics are degraded. On the other hand, when the amount of the organic peroxide is larger than 5.0 parts by weight, the core is too hard and brittle, and the durability is degraded, or the shot feel is poor.

The filler is not limited as long as it has been conventionally used for cores of golf balls, but includes inorganic filler such as zinc oxide, barium sulfate, calcium carbonate and the like. It is preferable to use fineparticle high molecular weight polyolefin powder or hollow particulate. The fineparticle high molecular weight polyolefin powder preferably has an average particle diameter of 10 to 50 μm, and examples thereof include "Mipelon XM-220" (trade name, average particle diameter: 20 μm, molecular weight: not less than 2 millions), which is commercially available from Mitsui Chemicals, Inc. The hollow particulate may be formed from inorganic material such as glass, ceramics and the like, or organic material such as acrylonitrile-methacrylonitrile copolymer, vinylidene chloride-acrylonitrile copolymer and the like. Examples of the fillers include a hollow particulate of soda-lime borosilicate glass, which is commercially available from Sumitomo 3M co., Ltd. under the trade name of "Glassbubbles" (such as "Glassbubbles B37/2000", "Glassbubbles B38/4000", "Glassbubbles B46/4000", "Glassbubbles S60/10000"); methacrylonitrile-acrylonitrile copolymer, which is commercially available from Chema Norval Co. under the trade name of "Expancel" (such as "Expancel 091DE", "Expancel 091DE80" and the like. The amount of the filler is 1 to 30 parts by weight, preferable 5 to 20 parts by weight, based on 100 parts by weight of the base rubber. When the amount of the filler is smaller than 1 parts by weight, the technical effects of lightening the resulting golf ball are not sufficiently obtained. On the other hand, when the amount of the filler is larger than 30 parts by weight, the durability is easily degraded.

The rubber composition for the core of the golf ball of the present invention can contain high-styrene resin and the like in order to impart hardness to the resulting golf ball. The rubber composition can optionally contain other components, such as softening agent, liquid rubber or antioxidant.

The core used for the golf ball of the present invention can be obtained by mixing with a mixer such as a mixing roll, kneader and the like, and then press-molding the above rubber composition under applied heat of 130 to 170° C. for 10 to 30 minutes in a mold. In the present invention, the core has a diameter of 36.5 to 42.5 mm, preferably 36.7 to 40.8 mm. When the diameter of the core is smaller than 36.5 mm, the thickness of the cover is large, and the impact force at the time of hitting is large. In addition, the volume of the core is small, and the rebound characteristics are degraded. On the other hand, when the diameter of the core is larger than 42.5 mm, the thickness of the cover is small, and the durability is degraded.

The cover is then covered on the core. In the golf ball of the present invention, it is desired for the cover to have a thickness of 0.3 to 3.5 mm, preferably 1.0 to 3.0 mm. When the thickness is smaller than 0.3 mm, the durability of the cover is degraded. On the other hand, when the thickness is larger than 3.5 mm, the volume of the core is small or the deformation reached to the core at the time of hitting is small, the rebound characteristics are degraded.

The cover of the present invention is not limited as long as it has properties as described above, but contains thermoplastic resin, particularly ionomer resin, which has been conventionally used for the cover of golf balls, as a base resin. The ionomer resin may be a copolymer of ethylene and α,β-unsaturated carboxylic acid, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856, Hi-milan AM7316 and the like. Examples of the ionomer resins, which are commercially available from Du Pont Co., include Surlyn 8945, Surlyn 9945, Surlyn 6320, Surlyn 8320, Surlyn AD8511, Surlyn AD8512, Surlyn AD8542 and the like. Examples of the ionomer resins, which are commercially available from Exxon Chemical Co., include Iotek 7010, Iotek 8000 and the like. These ionomer resins may be used alone or in combination.

As the materials suitably used in the cover 3 of the present invention, the above ionomer resin may be used alone, but the ionomer resin may be used in combination with at least one of thermoplastic elastomer, diene-based block copolymer and the like.

Examples of the thermoplastic elastomers include polyamide-based thermoplastic elastomer, which is commercially available from Toray Co., Ltd. under the trade name of "Pebax" (such as "Pebax 2533"); polyester-based thermoplastic elastomer, which is commercially available from Toray-Du Pont Co., Ltd. under the trade name of "Hytrel" (such as "Hytrel 3548", "Hytrel 4047"); polyurethane-based thermoplastic elastomer, which is commercially available from Takeda Badische Urethane Industries, Ltd. under the trade name of "Elastollan" (such as "Elastollan ET880"); and the like.

The diene-based block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene-based block copolymers, which are commercially available, include the diene block copolymers, which are commercially available from Daicel Chemical Industries, Ltd. under the trade name of "Epofriend" (such as "Epofriend A1010") and the like.

The amount of the thermoplastic elastomer or diene-based block copolymer is 1 to 60 parts by weight, preferably 1 to 35 parts by weight, based on 100 parts by weight of the base resin for the cover. When the amount is smaller than 1 parts by weight, the technical effects of absorbing the impact force at the time of hitting accomplished by using them are not sufficiently obtained. On the other hand, when the amount is larger than 60 parts by weight, the cover is too soft and the rebound characteristics are degraded, or the compatibility with the ionomer resin is degraded and the durability is degraded.

The composition for the cover used in the present invention may optionally contain pigments (such as titanium dioxide, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering with the cover is not specifically limited, but may be a conventional method. For example, there can be used a method comprising molding the cover composition into a semi-spherical half-shell in advance, covering the core, which is covered with the intermediate layer, with the two half-shells, followed by pressure molding at 130 to 170° C. for 1 to 5 minutes, or a method comprising injection molding the cover composition directly on the core to cover it. At the time of molding the cover, many depressions called "dimples" may be optionally formed on the surface of the golf ball. Furthermore, paint finishing or marking with a stamp may be optionally provided after the cover molded for commercial purposes.

The diameter of the golf ball of the present invention is preferably formed to a diameter of 42.67 to 42.90 mm, in accordance with the regulations for large size golf balls, that is, a diameter of at least 42.67 mm.

EXAMPLES

The following Examples and Comparative Examples further illustrate the present invention in detail but are not to be construed to limit the scope of the present invention.

Production of the Core

The rubber composition for the core having the formulations shown in Table 1 (Examples) and Table 2 (Comparative Examples) was mixed, and the mixture was then press-molded at 155° C. for 16 minutes, and then 160° C. for 8 minutes in a mold, which is composed of an upper mold and a lower mold having a hemispherical cavity, to obtain a spherical core having a diameter of 38.5 mm.

TABLE 1

(parts by weight)

| | Example No. | | | | |
|---|---|---|---|---|---|
| | 1 | 2 | 3 | 4 | 5 |
| BR11 *1 | 60 | 60 | 60 | 60 | 60 |
| VCR412 *2 | 40 | 40 | 40 | 40 | 40 |
| Mipelon XM-220 *3 | 15 | 15 | 15 | 15 | 15 |
| Nipol 2007J *4 | 13 | 13 | 13 | 13 | 13 |
| Zinc oxide | 10 | 10 | 10 | 10 | 10 |
| Hollow particulate *5 | 10 | 10 | 10 | 10 | 10 |
| Methacrylic acid | 7 | 7 | 6 | 7 | 7 |
| Dicumyl peroxide | 1.2 | 1.5 | 1.5 | 1.5 | 1.2 |

TABLE 2

(parts by weight)

| | Comparative Example No. | | | | |
|---|---|---|---|---|---|
| | 1 | 2 | 3 | 4 | 5 |
| BR11 *1 | 60 | 60 | 60 | 60 | 60 |
| VCR412 *2 | 40 | 40 | 40 | 40 | 40 |
| Mipelon XM-220 *3 | 15 | 15 | 15 | 15 | 15 |
| Nipol 2007J *4 | 13 | 13 | 13 | 13 | 13 |
| Zinc oxide | 10 | 10 | 10 | 10 | 10 |
| Hollow particulate *5 | 10 | 10 | 10 | 10 | 10 |
| Methacrylic acid | 7 | 6 | 7 | 6 | 7 |
| Dicumyl peroxide | 1.5 | 1.5 | 2.0 | 1.0 | 2.0 |

*1 Cis-1,4-polybutadiene rubber, which is commercially available from JSR Co., Ltd. under the trade name of "BR-11" (Content of 1,4-cis-polybutadiene: 96%)
*2 Polybutadiene rubber containing syndyotactic-1,2-polybutadiene of 12% by weight, cis-1,4-polybutadiene of 86% by weight and trans-1,4-polybutadiene of 2% by weight, which is commercially available from Ube Industries, Ltd. under the trade name of "UBEPOL-VCR412"
*3 Fineparticle high molecular weight polyolefin powder, which is commercially available from Mitsui Chemicals, Inc. under the trade name of "Mipelon XM-220" (average particle diameter: 20 μm, molecular weight: not less than 2 millions)
*4 High-styrene resin, which is commercially available from Nippon Zeon Co., Ltd. under the trade name of "Nipol 2007J"
*5 Hollow particulate of soda-lime borosilicate glass having a pressure resistance of 69 MPa and an average particle density of 0.60 g/cc, which is commercially available from Sumitomo 3M, Ltd.

Preparation of Cover Compositions

The formulation materials showed in Table 3 (Examples) and Table 4 (Comparative Examples) were mixed using a kneading type twin-screw extruder to obtain pelletized cover compositions. The extrusion condition was, a screw diameter of 45 mm,
a screw speed of 200 rpm, and
a screw L/D of 35.

The formulation materials were heated at 150 to 260° C. at the die position of the extruder. The flexural modulus of the resulting cover composition was determined according to ASTM D-790, using a sample of a heat and press molded sheet having a thickness of about 2 mm from the each composition, which had been stored at 23° C. for 2 weeks. The results are shown in Table 5 (Examples) and Table 6 (Comparative Examples).

TABLE 3

(parts by weight)

| | Example No. | | | | |
|---|---|---|---|---|---|
| Cover composition | 1 | 2 | 3 | 4 | 5 |
| Hi-milan 1555 *6 | 10 | 10 | 10 | — | — |
| Hi-milan 1605 *7 | 10 | 10 | 10 | — | — |
| Hi-milan 1705 *8 | — | — | — | — | 20 |
| Hi-milan 1706 *9 | — | — | — | — | 45 |
| Hi-milan 1855 *10 | 80 | 80 | 80 | 80 | 35 |
| Hi-milan 1856 *11 | — | — | — | 20 | — |
| Hi-milan AM7316 *12 | — | — | — | — | — |
| Surlyn 8320 *13 | — | — | — | — | — |
| Titanium dioxide | 1 | 1 | 1 | 1 | 1 |

TABLE 4

(parts by weight)

| | Comprative Example No. | | | | |
|---|---|---|---|---|---|
| Cover composition | 1 | 2 | 3 | 4 | 5 |
| Hi-milan 1555 *6 | — | — | 10 | 10 | — |
| Hi-milan 1605 *7 | — | 50 | 10 | 10 | — |
| Hi-milan 1705 *8 | — | — | — | — | 25 |
| Hi-milan 1706 *9 | — | 50 | — | — | 60 |
| Hi-milan 1855 *10 | 40 | | 80 | 80 | 15 |
| Hi-milan 1856 *11 | — | — | — | — | — |
| Hi-milan AM7316 *12 | 30 | — | — | — | — |
| Surlyn 8320 *13 | 30 | — | — | — | — |
| Titanium dioxide | 1 | 1 | 1 | 1 | 1 |

*6 Hi-milan 1555 (trade name), ethylene-methacrylic acid copolymer ionomer resin obtained by neutralizing with sodium ion, manufactured by Mitsui Du Pont Polychemical Co., Ltd.
*7 Hi-milan 1605 (trade name), ethylene-methacrylic acid copolymer ionomer resin obtained by neutralizing with sodium ion, manufactured by Mitsui Du Pont Polychemical Co., Ltd.
*8 Hi-milan 1705 (trade name), ethylene-methacrylic acid copolymer ionomer resin obtained by neutralizing with zinc ion, manufactured by Mitsui Du Pont Polychemical Co., Ltd.
*9 Hi-milan 1706 (trade name), ethylene-methacrylic acid copolymer ionomer resin obtained by neutralizing with zinc ion, manufactured by Mitsui Du Pont Polychemical Co., Ltd.
*10 Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd.
*11 Hi-milan 1856 (trade name), ethylene-acrylic ester-methacrylic acid terpolymer ionomer resin obtained by neutralizing with sodium ion, manufactured by Mitsui Du Pont Polychemical Co., Ltd.
*12 Hi-milan AM7316 (trade name), ethylene-n-butyl acrylate-methacrylic acid terpolymer ionomer resin obtained by neutralizing with zinc ion, manufactured by Mitsui Du Pont Polychemical Co., Ltd.
*13 Surlyn 8320 (trade name), ethylene-methacrylic acid copolymer ionomer resin obtained by neutralizing with sodium ion, manufactured by DuPont Co.

Examples 1 to 5 and Comparative Examples 1 to 5

The resulting cover compositions were covered on the core by injection molding to form the cover layer. Then, paint was applied on the surface to produce golf ball having a diameter of 42.7 mm. With respect to the resulting golf balls, the specific gravity, compression, durability and shot feel were measured or evaluated. The results are shown in Table 5 (Examples) and Table 6 (Comparative Examples). The test methods are as follows.

(Test Method)

(1) Durability

A No.1 wood club (W#1, a driver) having metal head was mounted to a swing robot manufactured by True Temper Co. and the resulting golf ball was hit at a head speed of 45 m/second to strike against an impact board, repeatedly. The durability is the number of hit until the cover of the golf ball cracks, and is indicated by an index when that of Comparative Example 1 is 100. The larger the number is, the better durability the golf ball has.

(2) Shot feel

The shot feel of the golf ball is evaluated by 10 golfers according to a practical hitting test using a driver. The evaluation criteria are as follows. The results shown in the Tables below are based on the fact that the most golfers evaluated with the same criterion about shot feel.

○: The golfers felt that the golf ball has small impact force, and good shot feel.

Δ: The golfers felt that the golf ball has fairly good shot feel.

x: The golfers felt that the golf ball has large impact force, and poor shot feel.

(Test Result)

TABLE 5

| | Example No. | | | | |
|---|---|---|---|---|---|
| Test item | 1 | 2 | 3 | 4 | 5 |
| Flexural modulus of cover F (MPa) | 100 | 100 | 100 | 85 | 170 |
| Ball compression D (mm) | 4.0 | 3.2 | 5.5 | 3.6 | 3.4 |
| Ratio (F/D) | 25 | 31 | 18 | 24 | 50 |
| Ball specific gravity | 0.957 | 0.957 | 0.957 | 0.957 | 0.957 |
| Durability | 141 | 144 | 100 | 137 | 128 |
| Shot feel | ○ | ○ | ○ | ○ | ○ |

TABLE 6

| | Comparative Example No. | | | | |
|---|---|---|---|---|---|
| Test item | 1 | 2 | 3 | 4 | 5 |
| Flexural modulus of cover F (MPa) | 40 | 320 | 100 | 100 | 225 |
| Ball compression D (mm) | 3.8 | 4.2 | 2.8 | 6.2 | 3.1 |

TABLE 6-continued

| | Comparative Example No. | | | | |
|---|---|---|---|---|---|
| Test item | 1 | 2 | 3 | 4 | 5 |
| Ratio (F/D) | 11 | 76 | 36 | 16 | 73 |
| Ball specific gravity | 0.957 | 0.957 | 0.957 | 0.957 | 0.957 |
| Durability | 85 | 84 | 123 | 72 | 94 |
| Shot feel | ○ | ○ | x | ○ | Δ |

As is apparent from Tables 5 to 6, the golf balls of the present invention of Examples 1 to 5 have a specific gravity of less than 1.0, and float on water. In addition, the golf balls have good shot feel and excellent durability and put as compared with the conventional golf balls of Comparative Examples 1 to 5.

On the other hand, in the golf ball of Comparative Example 1, since the flexural modulus of the cover is small and a ratio (F/D) is small, the shot feel is good, but the cover is too soft, and the cover is easy to cut and the durability is poor. In the golf ball of Comparative Example 2, since the flexural modulus of the cover is large and a ratio (F/D) is large, the cover is too hard, and the shot feel is poor. In addition, the deformation amount of the cover is smaller than that of the golf ball, and the durability is poor.

In the golf ball of Comparative Example 3, the ball compression is small, and the durability is excellent, but the golf ball is too hard and the shot feel is poor. In the golf ball of Comparative Example 4, the ball compression is large, and the shot feel is excellent, but the golf ball is too soft and the durability is poor.

In the golf ball of Comparative Example 5, both the flexural modulus of the cover and ball compression are within the scope of the present invention, but the ratio (F/D) is small, and only the cover is too hard and thus the shot feel is slightly poor. In addition, the core is easy to cut and the deformation amount of the cover is smaller than that of the golf ball, and thus the durability is slightly poor. The golf ball of the present invention can be obtained not only by adjusting the flexural modulus of the cover (F) and ball compression (D) to a specific range, but also by adjusting the ratio (F/D) to a specific range.

What is claimed is:

1. A floatable golf ball for a driving range comprising a core and a cover covering the core, wherein the cover has a flexural modulus (F) of 80 to 300 MPa, the golf ball has a specific gravity of not less than 0.5 and less than 1.0, and a deformation amount (D) of 3.0 to 6.0 mm when applying from an initial load of 98 N to a final load of 1275 N, and a ratio (F/D) of the flexural modulus of the cover (F) to the deformation amount of the golf ball (D) is with the range of 24 to 31.

* * * * *